US009532688B1

(12) United States Patent
Ebrahimi Afrouzi et al.

(10) Patent No.: US 9,532,688 B1
(45) Date of Patent: Jan. 3, 2017

(54) SPHERICAL OR OVOID ROBOTIC VACUUM

(71) Applicants: Ali Ebrahimi Afrouzi, San Jose, CA (US); Soroush Mehrnia, Copenhagen (DK); Amin Ebrahimi Afrouzi, Berkeley, CA (US); Masih Ebrahimi Afrouzi, Berkeley, CA (US); Azadeh Afshar Bakooshli, San Jose, CA (US)

(72) Inventors: Ali Ebrahimi Afrouzi, San Jose, CA (US); Soroush Mehrnia, Copenhagen (DK); Amin Ebrahimi Afrouzi, Berkeley, CA (US); Masih Ebrahimi Afrouzi, Berkeley, CA (US); Azadeh Afshar Bakooshli, San Jose, CA (US)

(73) Assignee: Bobsweep, Inc., Toronto (CA)

( * ) Notice: Subject to any disclaimer, the term of this patent is extended or adjusted under 35 U.S.C. 154(b) by 0 days.

(21) Appl. No.: 14/874,394

(22) Filed: Oct. 3, 2015

Related U.S. Application Data

(60) Provisional application No. 62/060,659, filed on Oct. 7, 2014.

(51) Int. Cl.

| | |
|---|---|
| ***A47L 9/28*** | (2006.01) |
| ***A47L 9/00*** | (2006.01) |
| ***A47L 5/22*** | (2006.01) |

(52) U.S. Cl.
CPC ..... *A47L 9/009* (2013.01); *A47L 5/22* (2013.01); *A47L 9/2805* (2013.01); *A47L 9/2884* (2013.01); *A47L 2201/00* (2013.01); *A47L 2201/04* (2013.01)

(58) Field of Classification Search
CPC ..... A47L 9/009; A47L 9/2884; A47L 5/22; A47L 9/2805; A47L 2201/00; A47L 2201/04
IPC ..... A47L 9/28
See application file for complete search history.

(56) References Cited

U.S. PATENT DOCUMENTS 8,877,110 B2 * 11/2014 Molinari ..... B29C 45/2628 264/259

* cited by examiner

*Primary Examiner* — David Redding

(57) ABSTRACT

A spherical or ovoid design for a robotic vacuum in which the housing of the vacuum also serves as the means by which the device moves. Steering of the device is controlled by adjusting the center of gravity within the housing. Perforations in the housing allow debris to be vacuumed into the device.

11 Claims, 3 Drawing Sheets

SPHERICAL OR OVOID ROBOTIC VACUUM

CROSS-REFERENCE TO RELATED APPLICATIONS

This application claims the benefit of provisional patent application Ser. No. 62/060,659, filed Oct. 7, 2014 by the first named inventor.

FIELD OF INVENTION

The present invention relates to the functional design for automated robotic vacuums.

BACKGROUND OF INVENTION

The following is a tabulation of some prior art that presently appears relevant:

U.S. Patent Documents

| U.S. Patent Documents | | | |
|---|---|---|---|
| Pat. No. | Kind Code | Issue Date | Patentee |
| 6,883,201 | B2 | Apr. 26, 2005 | Irobot Corporation |
| 5,940,927 | A | Aug. 24, 1999 | Aktiebolaget Electrolux |
| 8,671,507 | B2 | Mar. 18, 2014 | Irobot Corporation |
| 7,474,941 | B2 | Jul. 24, 2003 | Samsung Gwangju Electronics Co., Ltd. |
| 7,937,800 | B2 | May 10, 2011 | Jason Yan |
| 8,209,053 | B2 | Jun. 26, 2012 | Samsung Electronics Co., Ltd. |

Various designs have been invented for robotic vacuums that aim to improve performance and decrease cost and the amount of work required to maintain them. The fewer parts used in a machine, the smaller the probability is of a mechanical problem. Less maintenance is required to maintain machines with fewer parts.

A need exists for a robotic vacuum design that minimizes the amount of time and effort required for maintenance.

Another problem for many robotic vacuums is overcoming physical obstacles obstructing the path of the robotic vacuum. A need exists for a better way for a robotic vacuum to overcome obstacles without user intervention.

SUMMARY OF INVENTION

It is a goal of the present invention to provide a design for a robotic vacuum that minimizes the number of mechanical parts and thereby the time and effort needed to maintain a robotic vacuum.

It is a goal of the present invention to provide a robotic vacuum design that improves the device's ability to overcome obstacles without user intervention.

The present invention achieves the aforementioned goals through a spherical design for a robotic vacuum. The casing of the device serves as the wheel on which the device rolls in order to move about the work environment. The casing is perforated to allow debris on the work surface to be vacuumed into the device. Turning left and right is controlled by adjusting the center of gravity inside the sphere. The inertial force of the robot's weight aids driving, and therefore less electrical energy is required to drive the device and more energy is available for the main function: vacuuming.

In one embodiment, a pendulum is adjusted to change the center of gravity and control turning.

In another embodiment, a weight on a rod system is adjusted to change the center of gravity and control turning.

In some embodiments, the shape of the device may be slightly ovoid in order to increase the device's contact with the work surface for better vacuuming coverage.

DETAILED DESCRIPTION OF THE INVENTION

The present invention proposes a design for a robotic vacuum in which the housing of the device itself is the mechanism by which the vacuum moves about the work area.

Generally, the present invention is directed to a robotic vacuum housing that is spherical or ovoid in shape and turns about an axis parallel to the plane of the floor in order to travel through the work area. Perforations in the sphere allow debris from the work surface to penetrate the sphere to be vacuumed into the housing. The device is steered by moving the center of gravity within the housing.

Figure 1:
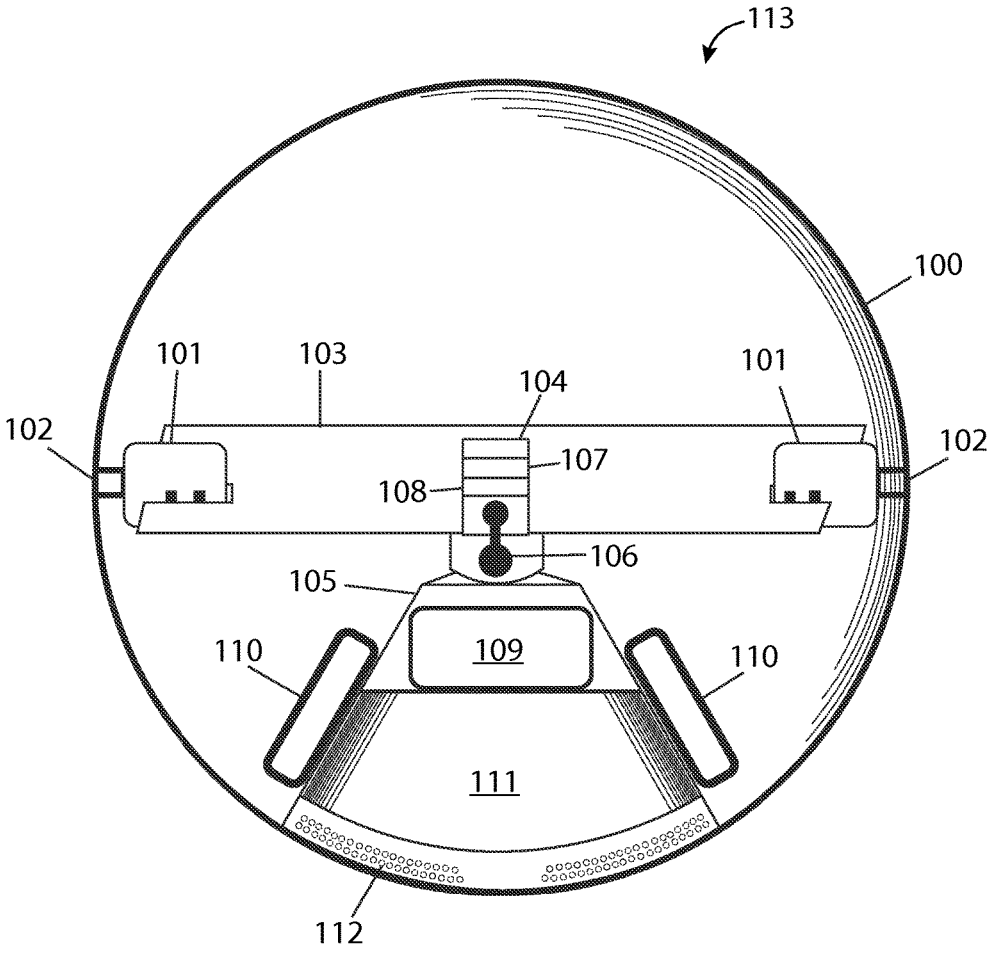
FIG. 1 illustrates a spherical robotic vacuum with a pendulum to control steering embodying features of the present invention.

In some embodiments, a pendulum is used to adjust the center of gravity within the housing. Referring to FIG. 1, a spherical robotic vacuum 113 is illustrated. At least one electric motor 101 drives the rotation of the spherical or ovoid housing 100 about a plate 103 provided parallel to the plane of the work surface through connecting bearings 102. The one or more motors are connected to the plate, which anchors the other components and creates an axis about which the housing turns. The pendulum is comprised of a weight assembly 105 connected to the plate by a hinge 106. The pendulum is moved by a high torque servomotor 104 directed by a control system 107. In some embodiments, the system may further comprise a gyroscope sensor 108 to provide exact calculations for directing the weight assembly. In some embodiments, other components may be attached to the weight assembly. In the example shown, the vacuum motor 109, batteries 110 and dustbin 111 are attached to the weight assembly. The pendulum may be strategically moved to change the center of gravity within the housing and thereby shift the trajectory of the housing as it rotates. Perforations 112 in the housing allow passage of debris from the work surface into the dustbin.

Figure 2:
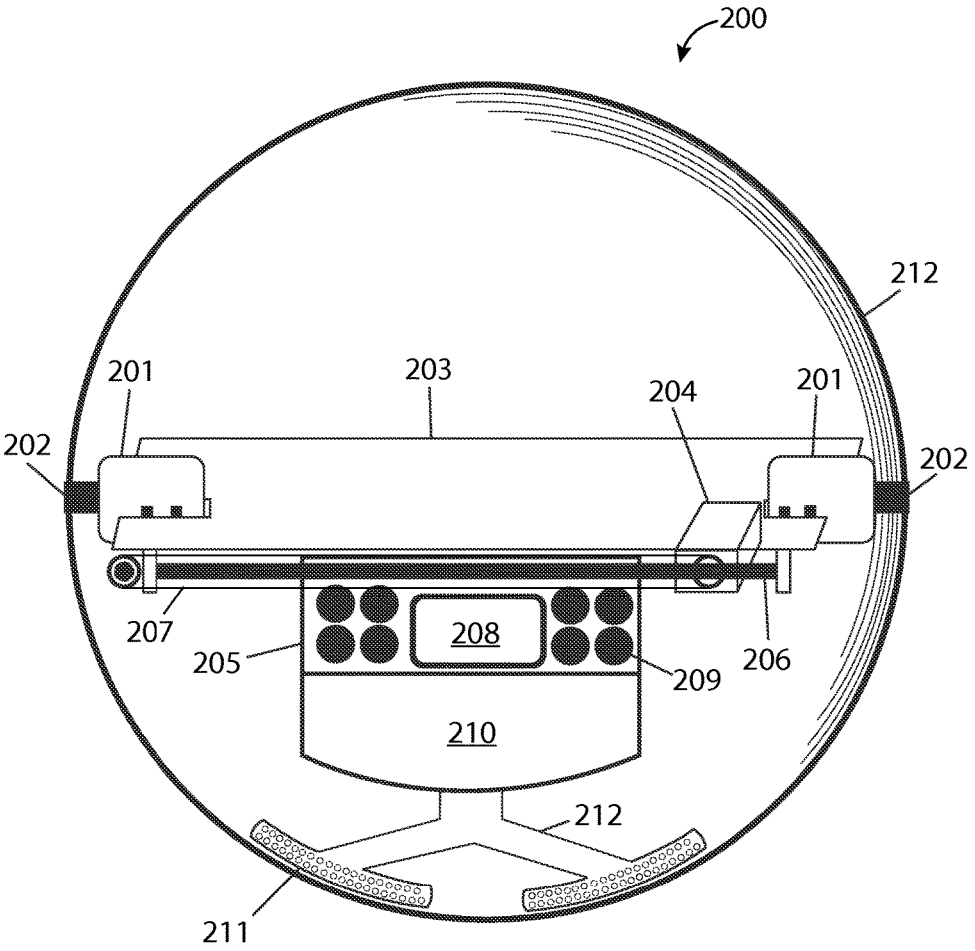
FIG. 2 illustrates a spherical robotic vacuum with a weight and rod system to control steering embodying features of the present invention.

In some embodiments, a weight and rod system, instead of a pendulum, is used to adjust the center of gravity within the housing. Referring to FIG. 2, a spherical robotic vacuum 200 is illustrated. At least one electric motor 201 drives the rotation of the spherical or ovoid housing 212 about a plate 203 provided parallel to the plane of the work surface. Bearings 202 connect the plate to the housing. The one or more motors are connected to the plate, which anchors the other components and creates an axis about which the housing turns. A servomotor or stepper motor 204 controls the position of a weight assembly 205 by pulling and pushing it along a rod 206 with a belt 207 in a manner parallel to the turning axis. In this way, the center of gravity of the housing may be shifted from one side to the other. In some embodiments, other components may be attached to the weight assembly. In the example shown, a vacuum motor 208, batteries 209, and dustbin 210 are attached to the weight assembly. In some embodiments, tubes 212 connect the dustbin to suction openings 211 where debris can enter the housing.

Figure 3:
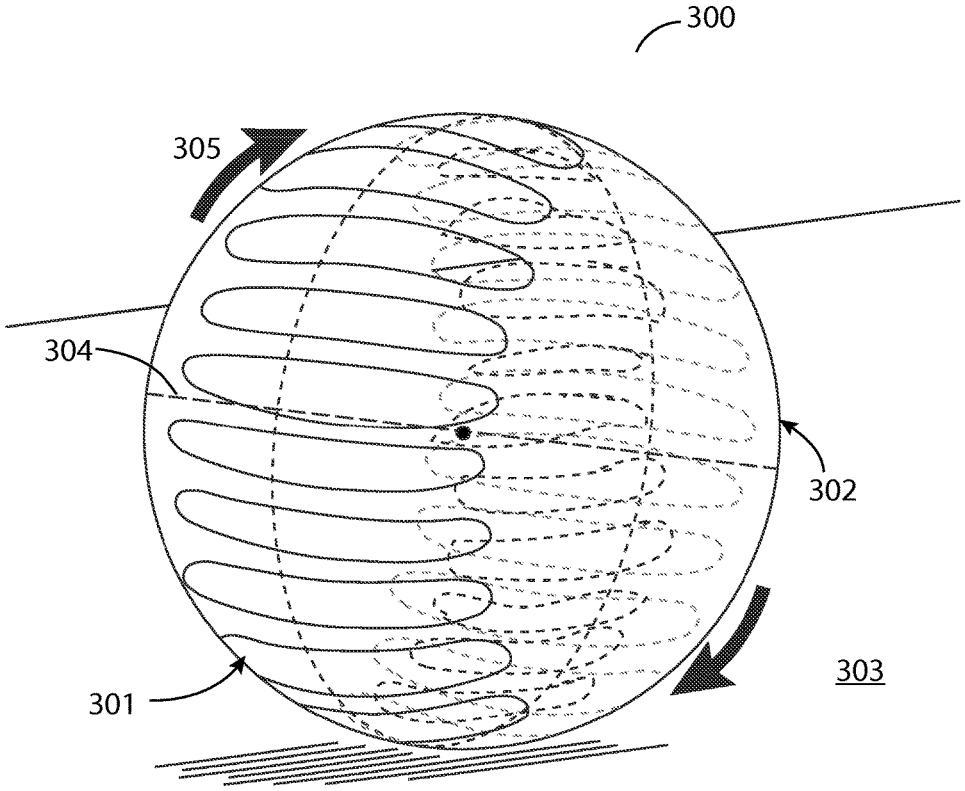
FIG. 3 illustrates a perspective view of a spherical robotic vacuum embodying features of the present invention.

Referring to FIG. 3, a three-dimensional perspective view of the proposed invention is illustrated. Perforations 301 in the spherical housing 302 of the robotic vacuum 300 allow debris from the work surface 303 to be vacuumed into the device. The housing turns about axis 304 in a direction 305, moving the device about the work area.

We claim:

1. A robotic vacuum comprising:

a perforated spherical or ovoid housing or casing;

a means for turning said housing about an axis parallel to the plane of a work surface;

a means for turning said housing in a left or right direction; and a means for vacuuming debris from a work surface within said housing.

2. The robotic vacuum of claim 1 wherein said means for turning said housing about an axis parallel to the plane of a work surface comprises:

providing a plate horizontally through the center of said housing;

providing bearings to attach said plate to said housing; and providing one or more driving motors to turn said bearings;

such that the running of said one or more driving motors causes said housing to turn.

3. The robotic vacuum of claim 1 wherein said means for turning said housing in a left or right direction comprises:

providing a rod parallel to the plane of the work surface;

providing a belt about said rod;

providing a weight assembly on said belt;

providing a servomotor or stepper motor to push or pull said belt;

whereby the center of gravity of said housing is changed by adjusting the position of said weight by pushing or pulling said belt with said servomotor or stepper motor, which causes said housing to turn in a left or right direction.

4. The weight assembly of claim 3 further comprising any of: a dustbin, one or more batteries, and a vacuum motor.

5. The robotic vacuum of claim 3 further comprising providing tubes connecting said housing perforations to a dustbin within said housing.

6. The robotic vacuum of claim 1 wherein said means for turning said housing in a left or right direction comprises:

providing a pendulum comprising a weight assembly;

providing a high torque servomotor to adjust the positioning of said pendulum; and providing a control system to direct the operation of said high torque servomotor;

whereby the center of gravity of said housing is changed by adjusting the positioning of said pendulum with said high torque servomotor, which causes said housing to turn in a left or right direction.

7. The means for turning said housing in a left or right direction of claim 6 further comprising providing a gyroscope sensor to more precisely calculate the necessary positioning of said pendulum.

8. The weight assembly of claim 6 further comprising any of: a dustbin, one or more batteries, and a vacuum motor.

9. A spherical or ovoid housing for a robotic vacuum with perforations or openings for allowing debris from a work area to enter said housing, a means for turning said housing about an axle provided parallel to the plane of a work surface, a means for turning said housing in a left or right direction, and a means for vacuuming debris from a work area within said housing.

10. The housing for a robotic vacuum of claim 9 wherein said means for turning said housing about an axle provided parallel to the plane of a work surface comprises:

providing bearings to attach said axle to said housing; and providing one or more driving motors to turn said bearings;

such that the running of said one or more driving motors causes said housing to turn.

11. The housing for a robotic vacuum of claim 9 wherein said means for turning said housing in a left or right direction comprises shifting the center of gravity of said housing by moving a weight assembly provided within said housing with a servomotor in a direction and degree calculated by a gyroscope sensor to achieve the desired turning degree and direction of said housing.

* * * * *